United States Patent [19]

Chardonneau et al.

[11] 4,052,907

[45] Oct. 11, 1977

[54] PUMPING DEVICE FOR WELLS, SUCH AS OIL WELLS

[75] Inventors: Joël Chardonneau, Orvault; Claude Sable, Reze, both of France

[73] Assignee: Centre d'Etudes et de Realisations Industrielles de l'Atlantique (Ceria), Nantes, France

[21] Appl. No.: 650,264

[22] Filed: Jan. 19, 1976

[30] Foreign Application Priority Data

Jan. 23, 1975 France ..... 75.02075

[51] Int. Cl.[2] ..... F16H 27/02

[52] U.S. Cl. ..... 74/89.22; 254/178

[58] Field of Search ..... 74/41, 89.22; 248/289; 254/178

[56] References Cited

U.S. PATENT DOCUMENTS

| | | | |
|---|---|---|---|
| 162,406 | 4/1875 | Nickerson et al. | 74/41 |
| 381,472 | 4/1888 | Heitzman | 248/289 |
| 1,453,997 | 5/1923 | Rivet | 248/289 |
| 1,478,636 | 12/1923 | Clayden | 248/289 |
| 3,057,213 | 10/1962 | Gourley | 74/41 |

FOREIGN PATENT DOCUMENTS

| | | | |
|---|---|---|---|
| 814,832 | 9/1951 | Germany | 254/178 |

*Primary Examiner*—Samuel Scott
*Assistant Examiner*—Wesley S. Ratliff, Jr.
*Attorney, Agent, or Firm*—Cushman, Darby & Cushman

[57] ABSTRACT

The invention concerns pumping apparatus for wells, such as oil wells, comprising a framework constituted by a tubular mast, a driving plant, a linkage connectable to a force pump immersed in the well, a flexible connection between the said plant and the said linkage for transmitting and imparting a reciprocating lifting and lowering movement to the rod linkage to actuate the force pump, the tubular mast including, for the connection to the rod linkage, guide pulleys with horizontal axes of rotation, and a lockable arm for carrying the guide pulleys and mounted for pivoting on the tubular mast about a vertical axis.

7 Claims, 8 Drawing Figures

24
23
21
24
20
22
24
22
27
12
10
26
25
11
18
1
TO PUMP 23
21
28
25
20
24
24
27
10
25
12
11
1

IV
12
10
21
29
28
29'
II
2
31
11
20
23'
I
32
1

PUMPING DEVICE FOR WELLS, SUCH AS OIL WELLS

BACKGROUND OF THE INVENTION

1. Field of the Invention

The invention concerns a pumping device for wells, such as oil wells, comprising a framework or rig and machinery capable of imparting, by the intermediation of a flexible connection, a reciprocating rising and falling movement to a set of rods or links whereby to actuate a force pump immersed in the well.

2. Description of the Prior Art

Pumping devices of this kind are known, e.g. from German Pat. No. 814,832 and U.S. Pat. No. 1,839,355, wherein the framework has, for the connection to the set of rods, at least one guide pulley with a horizontal axis of rotation carried on an arm for pivoting on the framework about a vertical axis.

However, these devices consist of lattice frameworks. In order to give the necessary strength to such frameworks, they must be fairly large and they thus occupy a relatively large surface area. Moreover, they are expensive to maintain, especially in a marine environment, and in use it is difficult to release the head of the well for servicing work. In addition, lattice frameworks do not permit a large pivotal angle to be achieved by the pivoting arm.

SUMMARY OF THE INVENTION

An aim of the invention is to propose a new type of pumping device of minimum ground or marine platform space requirement and which permits the complete disengagement in height of the servicing shaft of the well without complicated or costly operations and without displacement of material on the ground or on the platform. Another aim of the invention is to obtain a robust framework which allows the economical and convenient installation of counterweight balancing of a type known in itself.

These aims are attained, according to the invention, by the fact that the frame is constituted by a tubular mast. According to another characteristic, the arm pivotally mounted on the frame about a vertical axis is pivotable between at least two positions angularly spaced by about 90° from each other.

Preferably, in a pumping device comprising a device for counterbalancing the forces exerted on the flexible connection, two wells are coupled or twinned and each is served by a respective tubular mast so that counterbalancing is achieved by the coupling or twinning of the two pumps each immersed in its own well. It is then advantageous for the two tubular masts to be integrally joined together by a connecting means on the same base.

According to a variant, counterbalancing is achieved is a counterweight device accommodated in the tubular mast which serves as a guide therefor and which at its head carries a guide pulley for a flexible connection carrying the counterweight.

Expediently, the tubular mast includes a central guide rod fixed at the top and at the bottom of the mast and the counterweight device includes a safety device.

According to one embodiment, the horizontal axles of the guide pulleys carried by the pivotally mounted arms are carried on vertical axles and are adjustable in angular position on the pivoting arms.

Other characteristics and advantages will become clear from the description of preferred embodiments given hereafter, merely by way of example, with reference to the attached drawings.

Figure 1:
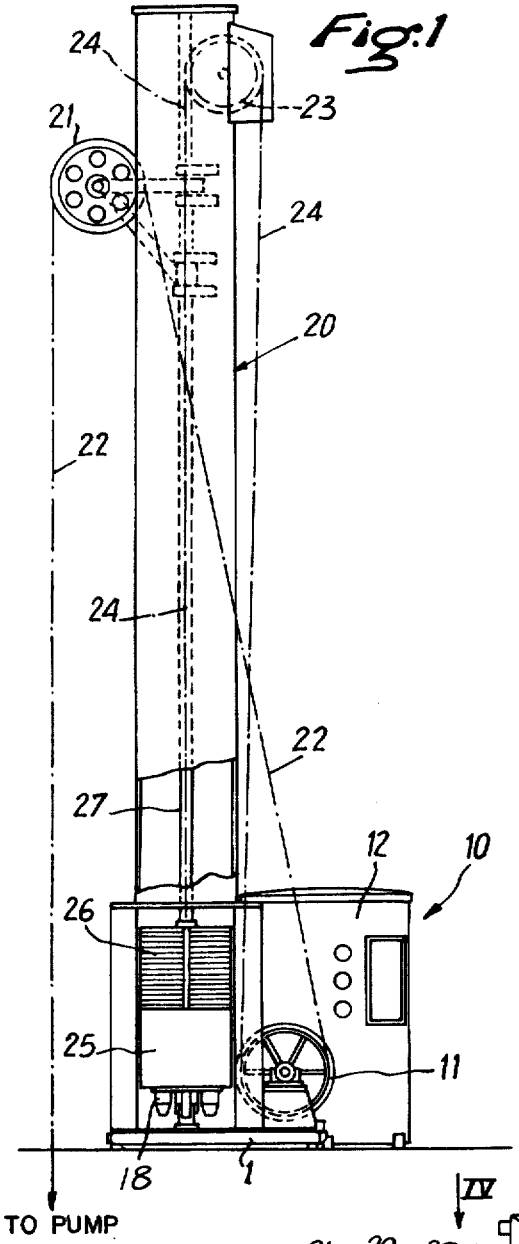
FIGS. 1 and 2 show in vertical elevation, partially broken away, two mutually orthogonal views from the front and from the left of the pumping apparatus according to the invention with counterweight counterbalancing means.
Figure 2:
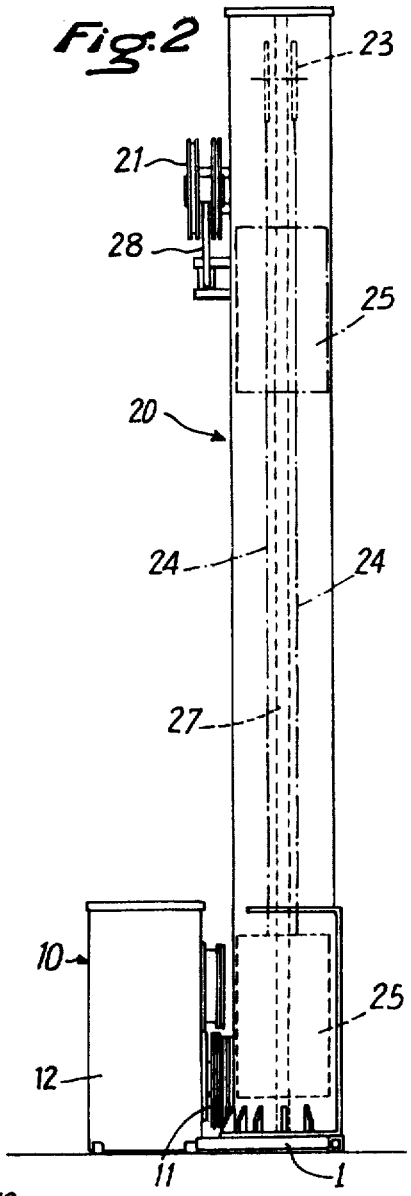
Figure 3:
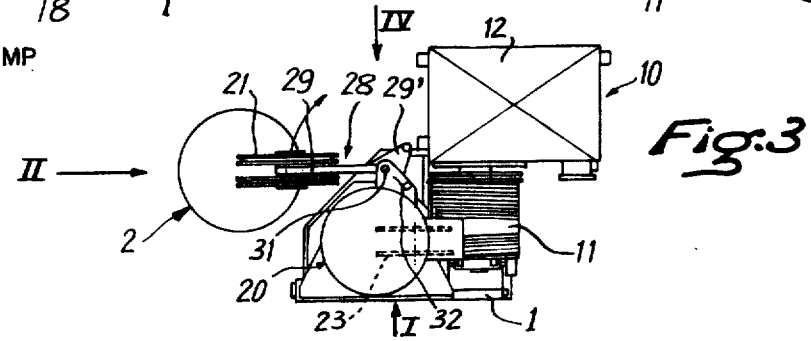
FIG. 3 shows in plan the apparatus of FIGS. 1 and 2, the respective viewing directions of FIGS. 1 and 2 being shown at I and II, FIGS. 4 and 5 respectively show on a larger scale the main parts of FIGS. 1 and 3, respectively as a rear view and a plan view after removal of the upper part of the mast.
Figure 4:
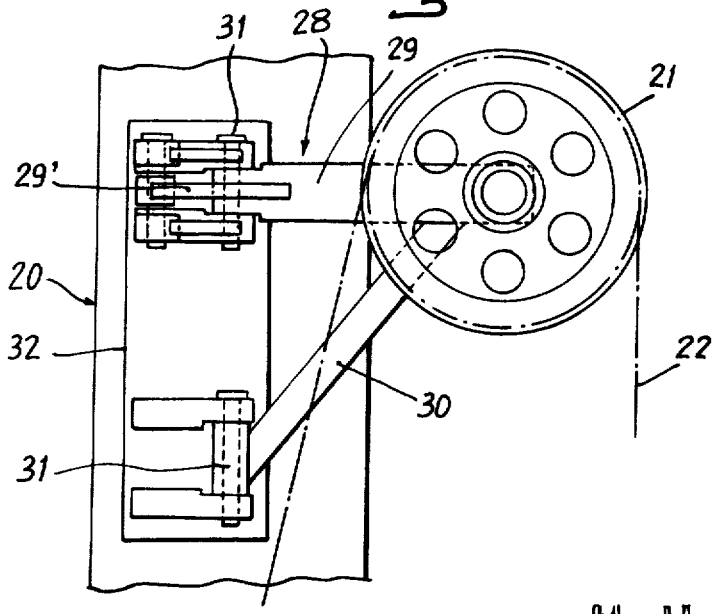

DESCRIPTION OF THE PREFERRED EMBODIMENTS:

The first preferrred embodiment of the apparatus according to the invention is shown in FIGS. 1 to 5. Essentially it consists of machinery or a plant 10 for actuating a winch 11 and a tubular mast 20 preferably connected to the machinery on the same pedestal or base 1. The tubular mast 20 carries two pairs of guide pulleys with horizontal axes of rotation, namely a lateral pair 21 for guiding a double cable 22 between the winch 11 and the non-illustrated set of rods or linkage, and an upper pair 23 for the guidance of a double cable 24 between the winch 11 and a counterweight 25 accommodated in the tubular mast 20.

The counterweight 25 includes interchangeable weights 26 to allow its weight to be adjusted, e.g. to the sum of the weight of the linkage and of one-half of the column of the liquid pumped.

The plant 10 actuating the winch 11 includes the following components which are not shown in detail: a hydraulic motor for actuating the winch, a variable-output pump for feeding this motor with hydraulic liquid (oil) and delivering an output of oil proportional to the opening angle of its control lever, in one direction or in the opposite direction according to whether this lever is to the one or to the other side of its zero position of no output; an electric motor for driving this pump, as well as a regulating flywheel for smoothing the peaks of intensity at the reversals of the direction of movement; a mechanism for reversing the direction of movement adapted to rock the control lever of the pump from one position to another symmetrically in relation to the zero point; an oil tank and an oil cooler; all the ancillary devices that are indispensable to the satisfactory operation and to the reliability of the installation, and a casing 12 enclosing all the components in a compact fashion.

The drum of the winch 11 carries the two cables 22 for the rod linkage and the two cables 24 for the counterweight 25. The doubling-up of the cables has the aim of ensuring their maximum service life. The drum of the winch 11 also allows the links of the linkage to be removed from the well.

The tubular mast 20 includes a central guide rod 27 fixed to the mast at the top and on the pedestal or base 1. The counterweight includes, in addition to the interchangeable weights 26, resilient suspension studs 18 for demounting.

The guide pulleys 23 for the suspension cables of the counterweight 25 are so mounted at the top of the mast that the strands 24 of these cables descend parallel to the guide rod 27.

As to the pulleys 21, they are carried at the end of a support arm or jib 28 pivotally mounted on the mast 20 at its upper part. The jib 28 includes an arm 29 and a bracket 30.

It is mounted for pivoting about a vertical axle 31 of a support 32 fixed to the mast 20. The arm 29 includes a crank 29' having a vertical slot 29'' serving to immobilize the arm in two places determined by vertical slots 32' and 32'' of the support 32. The two strands 22 are connected to the linkage by way of a rocking lever, as known per se.

Figure 8:
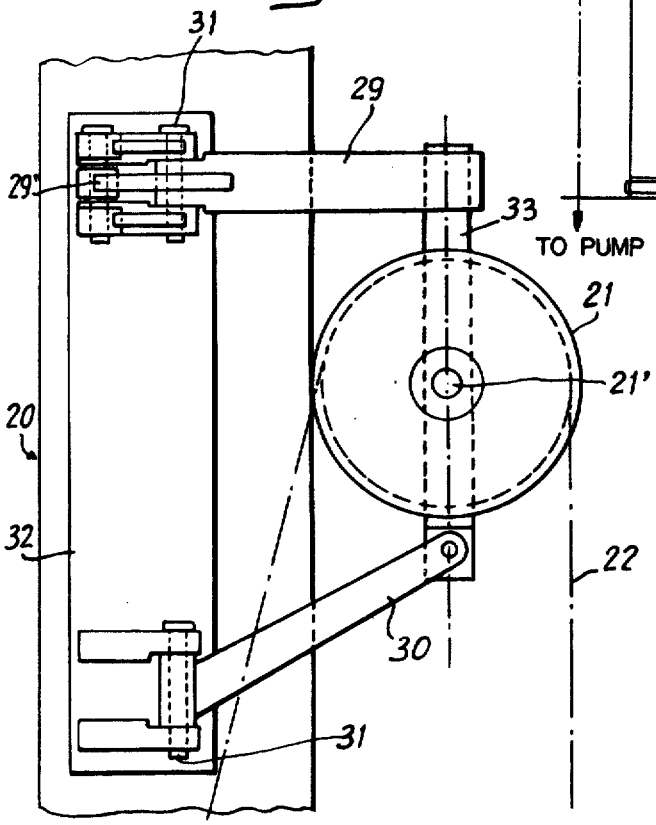
FIG. 8 is a side view of a variant of the device of FIGS. 4 and 5.

According to a variant shown in FIG. 8, the arm 29 and the bracket 330 are not connected to the axle of the pulleys 21 but are interconnected by a vertical spindle 33 around which the horizontal axle 21' of the pulleys 21 can swivel about a vertical axis in such a manner as to ensure a finer centering of the cables 22 on the axis of the linkage, i.e. to ensure that the cables pull more closely along this axis. The attachment points of the vertical spindle 33 to the arm and the bracket are then transferred to the outside of the height of the pulleys to permit optimal positioning of the latter.

Figure 5:
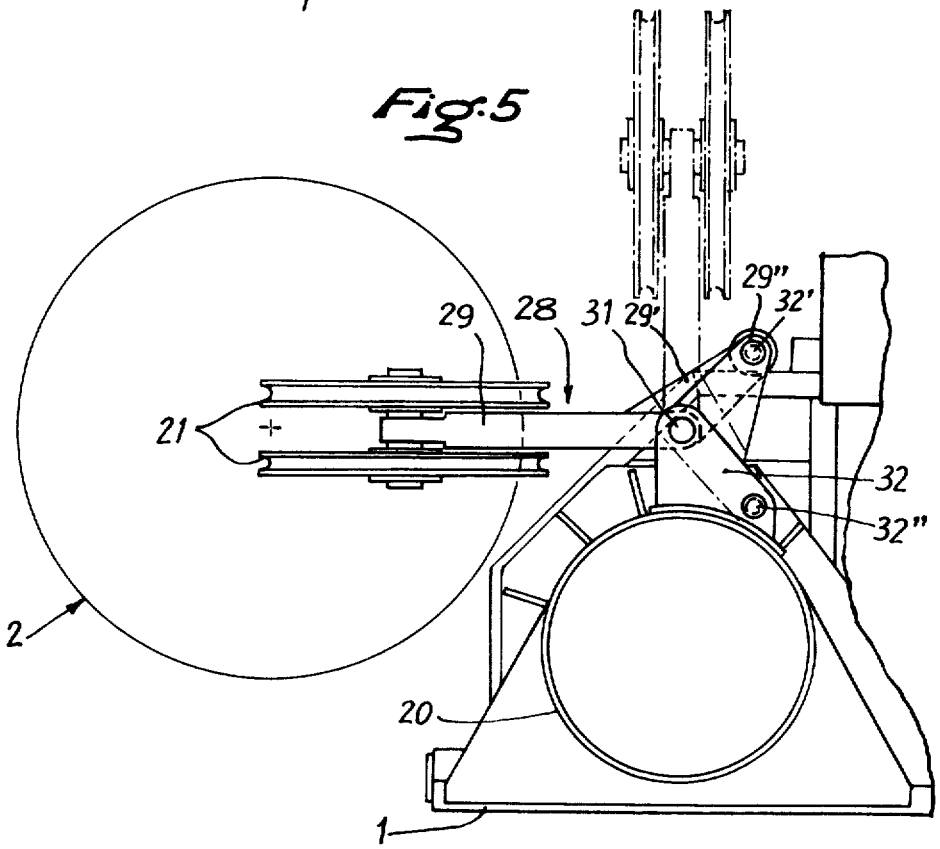

In the embodiment described hitherto, it will be appreciated that the assembly constituted by the jib 28 and the pulleys 21 carried thereby may be locked either in its pumping position represented in full lines in FIG. 5, wherein the cables 22 fall appreciably to the right of the centre of the shaft 2 of the well to be cleared, or in its retracted position represented in broken lines in FIG. 5, wherein the shaft 2 is wholly cleared in a vertical direction of all obstruction.

All the mechanical parts may be at ground level or at the level of the work floor where there is easy and complete access to the controls or dials. The circular shape and small diameter of the mast permits the pivoting assembly constituted by the jib, the pulleys and the crank of the jib to have a large angle of rotation, which facilitates servicing and maintenance of the well since a large zone 2 thereof can be freed.

In addition it will be seen that the total ground space requirement is much reduced, the strength of a tubular structure allowing its size to be greatly decreased in comparison with lattice structures. This advantage is very important for marine production platforms where provision of the floor area is costly.

Of course, the height of the mast 20 and the length of the cable made fast on the winch are such as to ensure the required vertical stroke for the pump and that the linkage can be raised by the winch, at least link by link.

Figure 7:
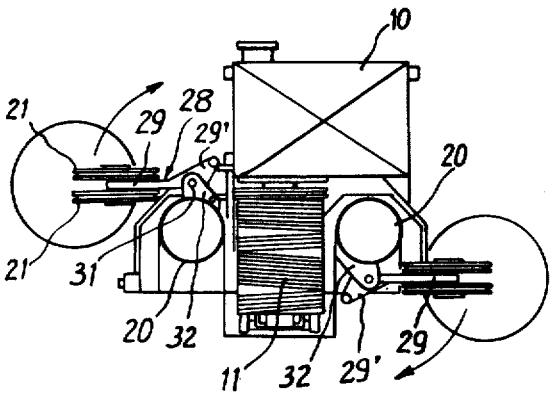
FIGS. 6 and 7 show, analogously to FIGS. 1 and 3, a variant including a counterbalancing arrangement by coupling two pumps immersed in two wells.
Figure 6:
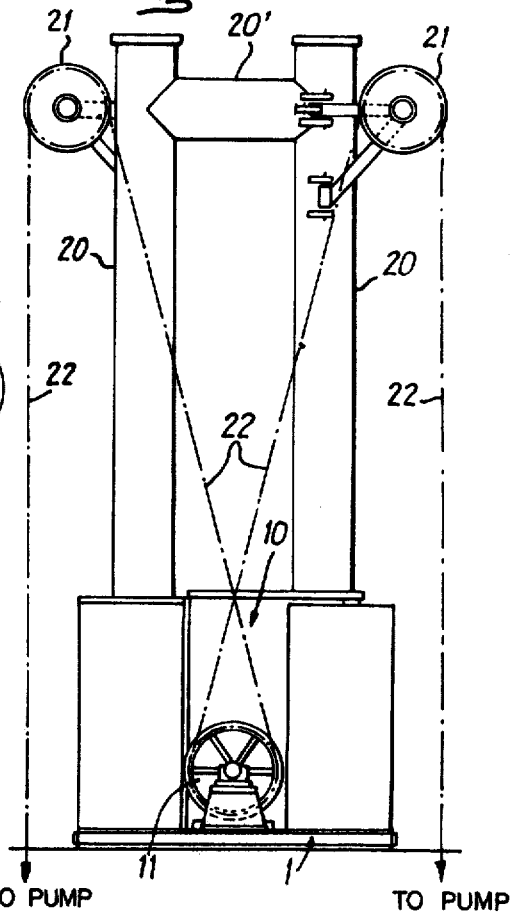

According to the variant shown in FIGS. 6 and 7 two pumps are each actuated, one in a respective well, by means of a respective linkage.

A sole base or pedestal 1 carries a single plant 10 and a single winch, the cables 22 being made fast on this winch and being directed to each of the linkages by means of pulleys 21 carried on two tubular masts 20 fixedly mounted on the base 1 and connected by a cross-bar 20'. This arrangement is favourable where the delivery and load of the two wells are generally balanced. The construction of the masts is the same as in the first embodiment described above except that these masts do not have counterweight balancing devices.

We claim as our invention:

1. An improved pumping apparatus for a well, comprising:
   - a vertically extending tubular mast;
   - at least one guide pulley having a horizontal axis of rotation;
   - means supporting said guide pulley outwardly from the mast, said supporting means being pivotally joined to said mast about a vertical axis to permit said pulley to be selectively positioned in alignment with a shaft of said well;
   - means for locking said supporting means in positions in and out of alignment with said shaft;
   - a driving plant;
   - a flexible connection extending from said driving plant and passing over said guide pulley, said connection being selectively joined to pumping means immersed within the well; and
   - means joined to said driving plant for counterbalancing forces exerted on said flexible connection.

2. An improved pumping apparatus as set forth in claim 1, wherein said counterbalancing means includes:
   - a further guide pulley supported by said mast at a location above the level of said driving plant;
   - a counterweight disposed within the mast; and
   - an additional flexilbe connection extending from the driving plant, passing over said further guide pulley, and joined to said counterweight.

3. An improved pumping apparatus as set forth in claim 2, wherein said mast and a vertically extending rod fixed within the mast serve as guides for said counterweight.

4. An improved pumping apparatus as set forth in claim 1, further comprising:
   - means pivotally joining the guide pulley to said supporting means about a vertical axis thereby permitting angular adjustment of said pulley.

5. An improved pumping apparatus for a well, comprising:
   - a vertically extending tubular mast;
   - at least one guide pulley having a horizontal axis of rotation;
   - means supporting said guide pulley outwardly from the mast, said supporting means being pivotally joined to said mast about a vertical axis to permit said pulley to be selectively positioned in alignment with a shaft of said well;
   - means for locking said supporting means in positions in and out of alignment with said shaft;
   - a driving shaft;
   - a flexible connection extending from said driving plant and passing over said guide pulley, said connection being selectively joined to pumping means immersed within the well; and
   - means joined to said driving plant for counterbalancing forces exerted on said flexible connection, said counterbalancing means including:
   - an additional vertically extending tubular mast;
   - a further guide pulley joined to said additional mast by a second guide pulley supporting means;
   - and a second flexible connection extending from the driving plant and passing over said second guide pulley to pumping means immersed within a second well.

6. An improved pumping apparatus as set forth in claim 5, further comprising:

means for interconnecting said tubular masts.

7. An improved pumping apparatus for a well comprising:

a vertically extending tubular mast;

at least one guide pulley having a horizontal axis of rotation;

means supporting said guide pulley outwardly from the mast, said supporting means being pivotally joined to said mast about a vertical axis to permit said pulley to be selectively positioned in alignment with a shaft of said well;

a driving plant;

a flexible connection extending from said driving plant and passing over said guide pulley, said connection being selectively joined to pumping means immersed within the well; and means joined to said driving plant for counterbalancing forces exerted on said flexible connection.

* * * * *